US011814888B2

(12) United States Patent
Hellwig et al.

(10) Patent No.: US 11,814,888 B2
(45) Date of Patent: Nov. 14, 2023

(54) FIRE PROTECTION FASTENING DEVICE FOR FASTENING A DOOR ACTUATOR

(71) Applicant: dormakaba Deutschland GmbH, Ennepetal (DE)

(72) Inventors: Alexander Hellwig, Ennepetal (DE); Thomas Salutzki, Ennepetal (DE); Sabine Wiemann, Ennepetal (DE); Volker Bienek, Ennepetal (DE)

(73) Assignee: DORMAKABA DEUTSCHLAND GMBH, Ennepetal (DE)

( * ) Notice: Subject to any disclaimer, the term of this patent is extended or adjusted under 35 U.S.C. 154(b) by 296 days.

(21) Appl. No.: 17/374,303

(22) Filed: Jul. 13, 2021

(65) Prior Publication Data

US 2022/0018175 A1 Jan. 20, 2022

(30) Foreign Application Priority Data

Jul. 20, 2020 (EP) ..... 20186680

(51) Int. Cl.

| | |
|---|---|
| ***E05F 1/00*** | (2006.01) |
| ***E06B 5/16*** | (2006.01) |
| ***E05F 3/22*** | (2006.01) |

(52) U.S. Cl.

CPC ..... *E05F 1/006* (2013.01); *E05F 3/227* (2013.01); *E06B 5/167* (2013.01); *E05Y 2800/414* (2013.01); *E05Y 2800/416* (2013.01); *E05Y 2900/134* (2013.01)

(58) Field of Classification Search

CPC ..... E05F 1/006; E05F 3/227; E06B 5/167; E05Y 2900/134; E05Y 2600/626; E05Y 2800/414; E05Y 2800/416

See application file for complete search history.

(56) References Cited

U.S. PATENT DOCUMENTS 5,709,009 A * 1/1998 Lasson ..... E05F 3/12 16/48.5
6,363,575 B1 * 4/2002 Kaser ..... E05B 65/104 16/48.5

(Continued)

FOREIGN PATENT DOCUMENTS

| | | |
|---|---|---|
| DE | 3423298 A1 | 1/1986 |
| EP | 3064684 A1 | 9/2016 |
| EP | 3366967 A1 | 8/2018 |

*Primary Examiner* — Jeffrey O'Brien

(74) *Attorney, Agent, or Firm* — CANTOR COLBURN LLP

(57) ABSTRACT

A fire protection fastening device for fastening a door actuator, includes a frame with a back side, which is to be oriented to a mounting surface, in particular to a door, casing or wall, wherein a mounting axis is defined vertically to the back side. The frame is formed for arrangement between a door actuator and the mounting surface or is an integral component of the door actuator (102), at least one reaction chamber formed in the frame, wherein the frame delimits the reaction chamber on the entire circumference. The reaction chamber is open on the back side and/or on a front side of the frame opposite the back side. The device further includes a drive element made from thermally intumescent material disposed in the reaction chamber and, when activated, is formed for pushing away the door actuator from the mounting surface.

13 Claims, 7 Drawing Sheets

(56) References Cited

U.S. PATENT DOCUMENTS

| | | | | |
|---|---|---|---|---|
| 7,670,216 | B2 * | 3/2010 | Chilelli | E05F 3/227 454/195 |
| 7,698,796 | B1 * | 4/2010 | Dowling | E05F 3/227 29/402.08 |
| 8,756,759 | B2 * | 6/2014 | Kaestle | E05F 3/22 16/49 |
| 10,975,595 | B2 * | 4/2021 | Hickman | E05B 47/00 |
| 2004/0098940 | A1 * | 5/2004 | Latessa | E05F 3/22 52/514 |
| 2014/0260929 | A1 * | 9/2014 | Leites | E05B 65/104 89/1.14 |
| 2021/0388657 | A1 * | 12/2021 | Hellwig | E05F 3/227 |
| 2022/0186527 | A1 * | 6/2022 | Hellwig | E05F 3/227 |
| 2023/0027773 | A1 * | 1/2023 | Hellwig | F16B 31/007 |

* cited by examiner

A - A

FIRE PROTECTION FASTENING DEVICE FOR FASTENING A DOOR ACTUATOR

CROSS-REFERENCE TO RELATED APPLICATIONS

This application is related to and claims the benefit of European Patent Application No. 20186680.3, filed on Jul. 20, 2020, the contents of which are herein incorporated by reference in their entirety.

TECHNICAL FIELD

The disclosure relates to a fire protection fastening device for fastening a door actuator. Furthermore, the disclosure shows assemblies comprising a door actuator along with a fire protection fastening device.

BACKGROUND

Door actuators are used for closing and/or opening doors. In particular, door closers and door drives are designated as door actuators. Generally, in a door closer, the manual opening movement charges a spring accumulator. In this case, the stored energy is used for closing the door. For example, in the door drive, electro-mechanics or hydraulics allow for automatically opening and/or closing the door.

Usually, door actuators are fastened to a mounting surface, namely on the door leaf or the casing, respectively the wall. In particular, with fire-rated doors, it should be noted that often combustible fluids, for example hydraulic oils, are used in the door actuators. In case of fire, as much as possible, suitable measures should allow for preventing the fluid in the door actuator from heating up too much and from potential igniting.

SUMMARY

The present disclosure indicates a fire protection fastening device for a door actuator, which allows for operation-reliable fastening the door actuator and simultaneously fulfills safety relevant requirements, in particular in case of fire.

The advantage is achieved by providing a device having the features of the independent claim. Advantageous further configurations of the disclosure are the subject matter of the dependent claims.

The disclosure describes a fire protection fastening device for fastening a door actuator. As mentioned in the introduction, a door closer or a door drive is a door actuator. The door actuator is to be fastened to a mounting surface. In particular, a door, casing or wall forms said mounting surface.

The fire protection fastening device comprises a frame. According to an embodiment of the disclosure, the frame is formed for arrangement between the door actuator and the mounting surface. When omitting a separate mounting plate, in this case, the door actuator rests directly on the front side of the frame. The back side of the frame faces the mounting surface; in particular, rests directly at the mounting surface. As will be described in more detail, a mounting plate can be used between the frame of the fire protection fastening device and the door actuator. In particular in this case, the mounting plate is screwed to the frame of the fire protection fastening device and the door actuator is fastened to the mounting plate.

In an alternative configuration, it is provided that the frame of the fire protection fastening device is an integral component of the door actuator. This configuration as well will be explained in more detail.

For describing the disclosure, a mounting axis is defined. The mounting axis is perpendicular to the frame, in particular perpendicular to the back side of the frame. Furthermore, the mounting axis is perpendicular to the mounting surface. The mounting axis is parallel to the screws, for example, which are used for screwing the frame to the mounting surface. According to an alternative definition, the mounting axis is perpendicular to the output axis of the door actuator. Via said output axis, the door actuator is to be connected to the door or the wall, for example via an arm assembly.

At least one reaction chamber is formed in the frame of the fire protection fastening device. In a preferred configuration, the frame includes several reaction chambers. In particular, two, three, four, five, six, seven or eight reaction chambers are provided in the frame. For the sake of simplicity, the disclosure is mostly described based on one reaction chamber, wherein it is always intended that the plurality of reaction chambers is formed identically. However, the reaction chambers can differ in size so that per geometric configuration of the fire protection fastening device, can be used the greatest possible number of reaction chambers with the greatest possible surface.

The frame delimits the respective reaction chamber on the entire circumference. With the depth thereof, the reaction chamber extends parallel to the mounting axis. Accordingly, also the circumference of the reaction chamber is defined with regard to an axis parallel to the mounting axis. The reaction chamber is open on the back side and/or on the front side of the frame. If the reaction chamber is open on both sides, i.e. on the front side and on the back side, it is question of a passage clearance in the frame. If the reaction chamber is only open on one of the two sides, it is question of a pocket, formed in particular in the frame.

A drive element is disposed in each reaction chamber. The drive element is manufactured from thermally intumescent material. When thermally activated, namely when correspondingly heating, the drive element is formed for pressing the door actuator away from the mounting surface. In particular, it is provided that the thermally activatable material of the drive element is activatable in a temperature range of 90° C. to 200° C.

The drive element is in particular a two-dimensional plate-shaped material, which is arbitrarily cuttable. As this material is available in certain thicknesses, preferably it is provided that several layers are placed one on top of the other for forming the drive element. Then, the plurality of layers together forms a drive element.

When activating the thermally intumescent material, the volume of said material increases, for example by foaming. As the drive element is disposed in the reaction chamber, and as the frame delimits the reaction chamber on the entire circumference, the drive element just expands in a direction parallel to the mounting axis. On account of the circumferential delimitation, the frame blocks the expansion of the drive element in a direction perpendicular thereto.

As already described, as a discrete component, the frame can be disposed between the door actuator and the mounting surface. If required, a mounting plate can be located between the frame and the door actuator. In this arrangement of the frame, the reaction chamber can be open both on the front side and on the back side. It is decisive that upon thermal activation, the drive element expands in the direction parallel to the mounting axis, whereby the door actuator is pushed away from the mounting surface. Whether or not the frame is pushed away as well or remains on the mounting surface side, is not relevant for the basic functioning of the disclosure.

In the configuration, in which the frame is an integral component of the door actuator, it is in particular provided that the reaction chamber is open on the back side for thus pushing the door actuator, together with the integral frame, away from the mounting surface.

When thermally activating the drive element, or the plurality of drive elements in the individual reaction chambers, pushing away the door actuator from the mounting surface is realized, wherein for example the male threads on the screws or the associated female threads break. Thereby, the door actuator comes off of the mounting surface, namely the door, casing or wall. In particular in this case, it is assumed that the door actuator is located on the side of the door facing away from the fire. The door actuator coming off of the mounting surface thereof prevents the door actuator from heating up too much, whereby the fluids in the door actuator are prevented from igniting.

In a preferred embodiment, it is provided that the fire protection fastening device includes a piston plate disposed in the reaction chamber. In particular, the piston plate is disposed such to the reaction chamber that the mounting axis is orthogonally to the piston plate. When employing several reaction chambers, one drive element and one respective preferably used piston plate are located in each reaction chamber.

In particular, the piston plate is formed from rigid material and serves for being displaced by the drive element, when thermally activating the drive element. In this case, it is in particular provided that the piston plate is guided in the reaction chamber. In particular, the displacement direction is parallel to the mounting axis. Preferably, the gap between the piston plate and the reaction chamber is to be kept as small as possible so that the intumescent material of the drive element does not squeeze through the gap past the piston plate. When being activated, namely upon expansion of the drive element, both the drive element and the piston plate can exit from the reaction chamber.

Basically the piston plate can be disposed on the front side or the back side of the drive element. Furthermore, it is possible to dispose one respective piston plate on both sides of the drive element. Accordingly then, two piston plates are provided per each reaction chamber.

The piston plates can be referred to as pressure distribution plates or pressure modulating plates, as they ensure that pressure, the drive element deploys, is transferred to an as large as possible a surface. Furthermore, they ensure that, when thermally activated, the drive element does not expand without use in hollow spaces, for example of the fissured back side of a door actuator.

Preferably, it is provided that the piston plate is manufactured from metal, for example from aluminium. Thereby, providing a strong, light-built and easily manufactured piston plate.

However, it should be considered that in most application cases, a thermally insulating configuration of the fire protection fastening device is advantageous. Basically, the heat input from the mounting surface into the drive element should be realized, if possible, without any resistance. However, any further heat conducting, in particular, in the direction of the door actuator, is to be prevented, if possible, Preferably, therefore it is provided that a piston plate, which is disposed between the drive element and the door actuator, is not made from non-metallic, thermally insulating material. As an alternative, the piston plate can have several layers, wherein at least one layer is made from non-metallic, thermally insulating material. Furthermore, it can be provided that a piston plate, which is disposed between the drive element and the mounting surface, is manufactured from metallic, thermally conducting material. Hereby, it is achieved that heat input from the mounting surface into the drive element is speedy for insuring an early volume increase of the intumescent material. Thus, it can be provided that the drive element be enclosed by two different piston plates, in particular by two piston plates having differing thermal conductivity.

In particular when manufacturing the piston plate exclusively from the thermally insulating material, it should be observed using correspondingly stable material for embodying a rigid piston plate. Appropriate plastic materials are suitable for this purpose.

In addition or as an alternative to using the thermally insulating material in the piston plate, preferably, it is provided that on at least one side of the piston plate, at least one insulating plate is placed, which is made from non-metallic, thermally insulating material. Preferably, the insulating plate is made from fibre composite.

If the insulating plate is placed between the piston plate and the drive element, in particular, it is located in the reaction chamber. If the insulating plate is placed on the side of the piston plate facing away from the drive element, it can be located outside the reaction chamber.

The individual reaction chamber has a cross-sectional area perpendicular to the mounting axis. In particular, said cross-sectional area of the reaction chamber is rectangular, as this geometrical configuration allows for distributing over the frame as many reaction chambers as possible or reaction chambers having a large surface. However, also other cross-sectional areas are possible. Preferably, however, it is provided that the drive element and/or the piston plate and/or the insulation plate extend/s over the entire cross-sectional area.

Preferably, the reaction chamber is open on both sides, i.e. on the front side and on the back side. In particular, the reaction chamber is open on both respective sides over the entire cross-section. The open back side of the reaction chamber is advantageous in that herein the drive element can be directly in direct contact with the mounting surface. Thereby, in case of fire, realizing an as quick as possible and sufficient warming of the drive element. Via the open front side, the drive element can expand in the direction of the door actuator, respectively push the piston plate in the direction of the door actuator.

The fire protection fastening device is formed as flat as possible and, if possible, is configured so that it can be disposed inconspicuously between door actuator and mounting surface. A depth of the individual reaction chambers is defined perpendicularly to the mounting surface. Preferably, said depth of the reaction chamber is between 1 mm and 30 mm, in particular between 5 mm and 20 mm. Thereby, sufficient construction space is given for disposing the drive element, if required also the piston plate, in the reaction chamber.

The cross-sectional area of the individual reaction chambers is defined perpendicularly to the mounting axis. Preferably, the area amounts to between 400 $mm^2$ and 50,000 $mm^2$, preferably between 900 $mm^2$ and 10,000 $mm^2$.

When using several reaction chambers, also the sum of all cross-sectional areas is of interest, as an as large as possible a cross-sectional area can deploy a correspondingly high force for pushing the door actuator away. Thus preferably, the sum of all cross-sectional areas of all reaction chambers amounts at least to 2,500 $mm^2$, in particular at least to 5,000 $mm^2$.

According to an already described configuration, the frame is not an integral component of the door actuator, but is disposed between mounting surface and door actuator, respectively mounting plate. In this case in particular, it is provided that the frame includes first fastening points for screwing to the mounting surface. Furthermore, second fastening points are formed in the frame, at which the door actuator or a potential mounting plate can be fastened to the frame. In particular, the fastening points are through-holes. In particular, for the second fastening points the through-holes preferably have a female thread. As an alternative to the configuration as holes, threaded rods can form the fastening points, for example.

For the herein described dimensions of the fastening points, respectively are relevant the centres thereof, namely the hole centres.

Respectively two first and second fastening points located next to each other preferably form a pair. For example, on the right side of the frame are provided two first and two second fastening points. Correspondingly for example, on the left side of the frame are provided two first and two second fastening points. Thus resulting in respectively two pairs on both sides of the frame.

With the intention to achieve a possibly direct force input on the fastening points, when pushing away the door actuator, preferably, it is provided that the distance of the fastening points of one pair is as small as possible. In particular, the distance between first fastening points and second fastening points of the respective pair is at most 5 times, preferably at most 4 times the thickness of the frame. In this case, the thickness of the frame is defined parallel to the mounting axis. Preferably in this case, the frame is crucial at the thickest point thereof. As an alternative, respectively the averaged thickness of the frame is crucial in the area between the fastening points of a pair. If the distance of the fastening points of a pair is too large, it can be that the frame just deforms, without the door actuator coming off of the frame.

Furthermore, the disclosure comprises a first assembly with a door actuator and the above-described fire protection fastening device, wherein the frame of the fire protection fastening device is formed as an integral component of the door actuator. In particular, the door actuator includes a housing, for example made from die-casting. In particular, at least one hydraulic chamber with the inflammable fluid is located in the housing. Preferably, the frame is formed on the back side of the door actuator, in particular of the housing. In particular in this case, it is intended just one reaction chamber is provided correspondingly with one drive element in the frame. In this case, the piston plate can be located at the back side of the frame.

Furthermore, the disclosure comprises a second assembly with a door actuator and the described fire protection fastening device, wherein the door actuator can be fastened, in particular screwed, directly to the frame. Preferably in turn, the frame of the fire protection fastening device can be directly fastened, in particular screwed to the mounting surface.

Furthermore, the disclosure comprises a third assembly with door actuator and described fire protection fastening device, as well as an additional mounting plate. In this case, the mounting plate is to be disposed between fire protection fastening device and door actuator. The mounting plate is fastened, in particular screwed to the frame of the fire protection fastening device. In turn the frame of the fire protection fastening device is to be screwed to the mounting surface. In this case, the door actuator can be connected, in particular screwed in a usual manner to the front side of the mounting plate. When thermally activated, the mounting plate is pushed away from the mounting surface. In this case, the door actuator together with the mounting plate comes off.

The advantageous configurations and dependent claims described in conjunction with the inventive fire protection fastening device find advantageous use for all three assemblies.

BRIEF DESCRIPTION OF THE DRAWINGS

The disclosure is now described in more detail based on exemplary embodiments. In this case, it shows.

DETAILED DESCRIPTION OF THE DRAWINGS

Figure 1:
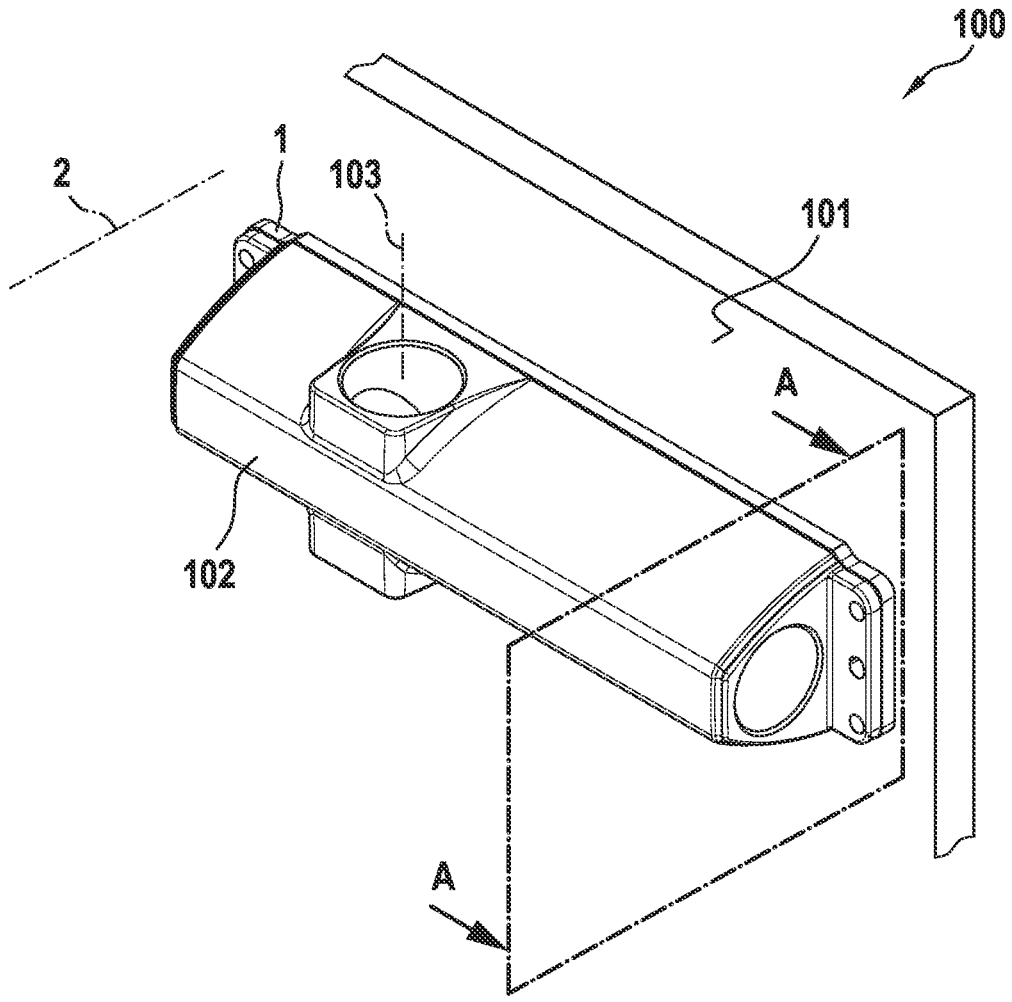
FIG. 1 an inventive assembly with inventive fire protection fastening device according to a first exemplary embodiment, FIG. 2 an exploded illustration for FIG. 1, FIG. 3 a frame of the inventive fire protection fastening device according to the first exemplary embodiment, FIG. 4 the section A-A identified in the FIGS. 1 and 3, FIG. 5 an exploded illustration of an inventive assembly with inventive fire protection fastening device according to a second exemplary embodiment, FIG. 6 an exploded illustration of an inventive assembly with inventive fire protection fastening device according to a third exemplary embodiment, and FIG. 7 a detail to FIG. 6.

In the following, are explained several exemplary embodiments of the disclosure. The same reference numerals identify the same, respectively functionally same structural components in all exemplary embodiments.

All exemplary embodiments show an assembly 100 with a door actuator 102. In the exemplary embodiments, the door actuator 102 is formed as a hydraulic door actuator. The door actuator 102 includes an output axis 103. Via said output axis 103, the door actuator can be connected to a door or a casing by means of an arm assembly, for example.

The door actuator 102 is to be fastened to a mounting surface 101. In particular, a door, casing or wall forms said mounting surface 101. A mounting axis 2 is perpendicular to the mounting surface 101.

A fire protection fastening device 1 is used for fastening the door actuator 102 to the mounting surface 101. The fire protection fastening device 1 comprises a frame 3. In the first two exemplary embodiments according to the FIGS. 1 to 5, said frame 3 is a separate structural part. In the third exemplary embodiment according to the FIGS. 6 and 7, the frame 3 is an integral component of the door actuator 102.

The frame 3 includes at least one reaction chamber 4. The reaction chamber 4 accommodates a drive element 7 and a piston plate 8. Furthermore, partially are used insulating plates 9.

The side of the frame 3, facing the mounting surface 101, is referred to as the back side 5. The opposite side is referred to as the front side 6.

The FIGS. 1 to 4 show the fire protection fastening device 1 of the assembly 100 according to the first exemplary embodiment. In this case, the frame 3 with the back side 5 thereof is fastened to the mounting surface 101. The door actuator 102 is directly mounted on the front side 6 of the frame 3.

Figure 2:
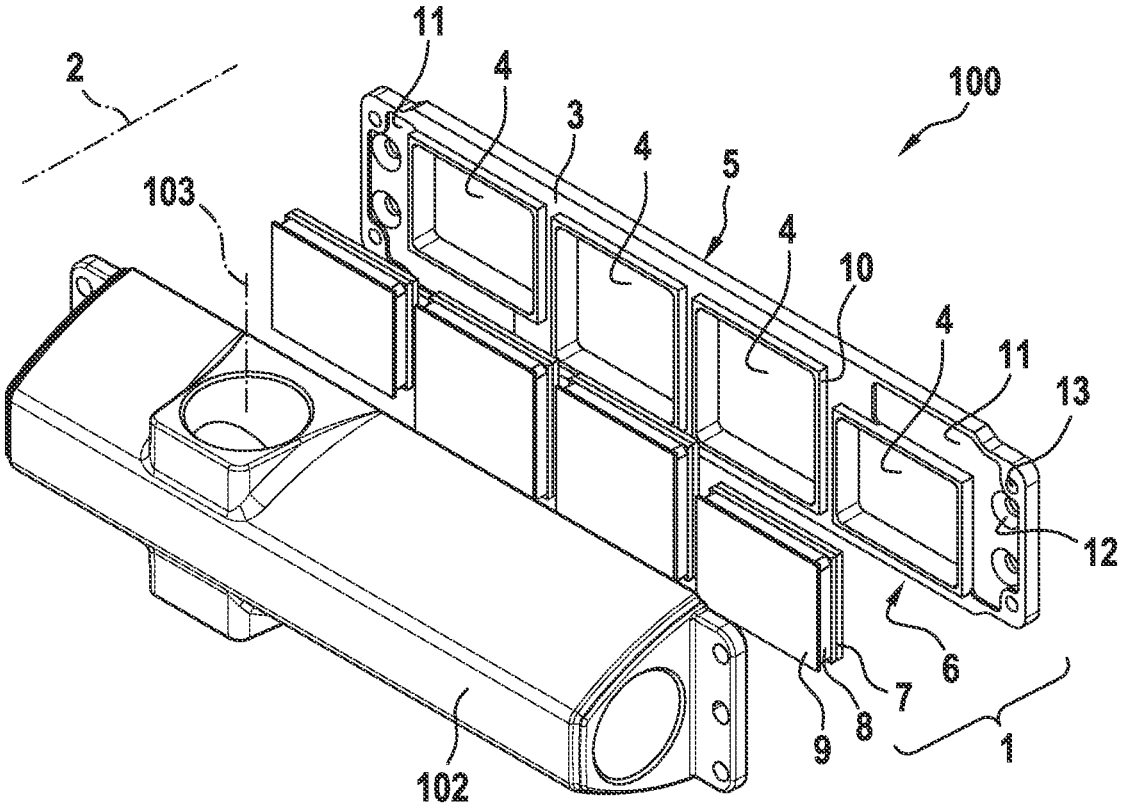
Figure 3:
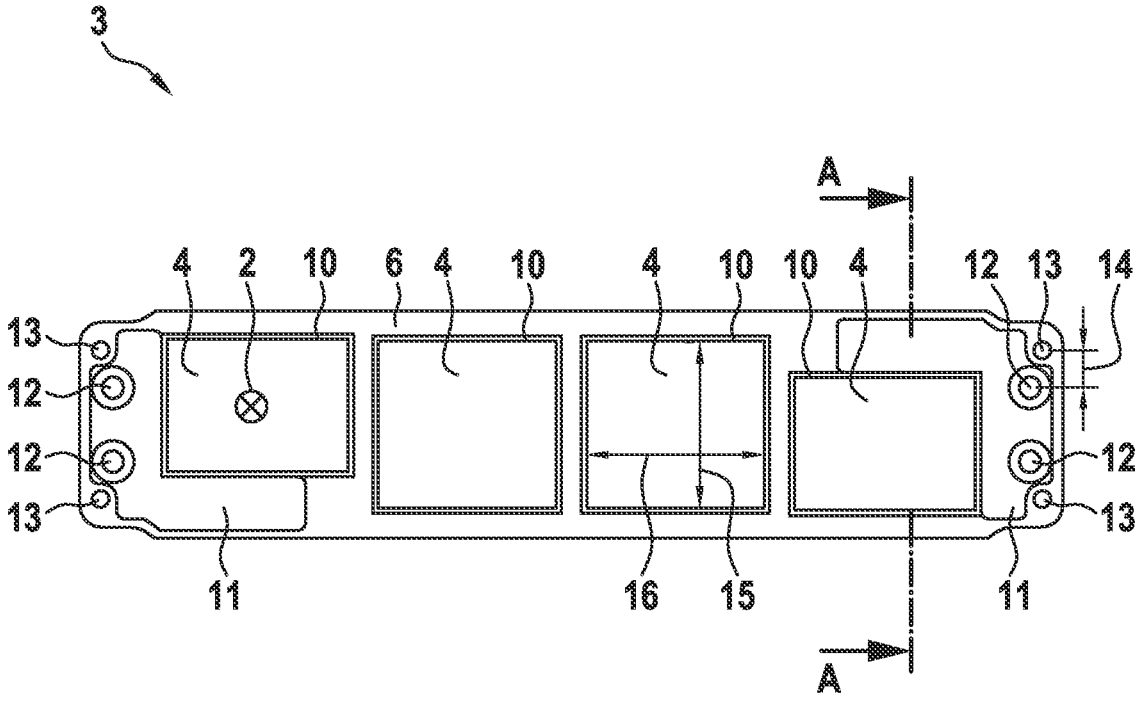

As revealed in FIGS. 2 and 3, the frame 3 has four reaction chambers 4. A sandwich of drive element 7, piston plate 8 and insulting plate 9 is located in each reaction chamber 4. In this case, as shown in the section of FIG. 4, the insulating plate 9 can be disposed outside the reaction chamber 4.

Herein, the drive element 7 is formed from two layers of thermal intumescent material. The piston plate 8, for example made from aluminium, is disposed between the insulating plate 9 and the drive element 7.

Figure 4:
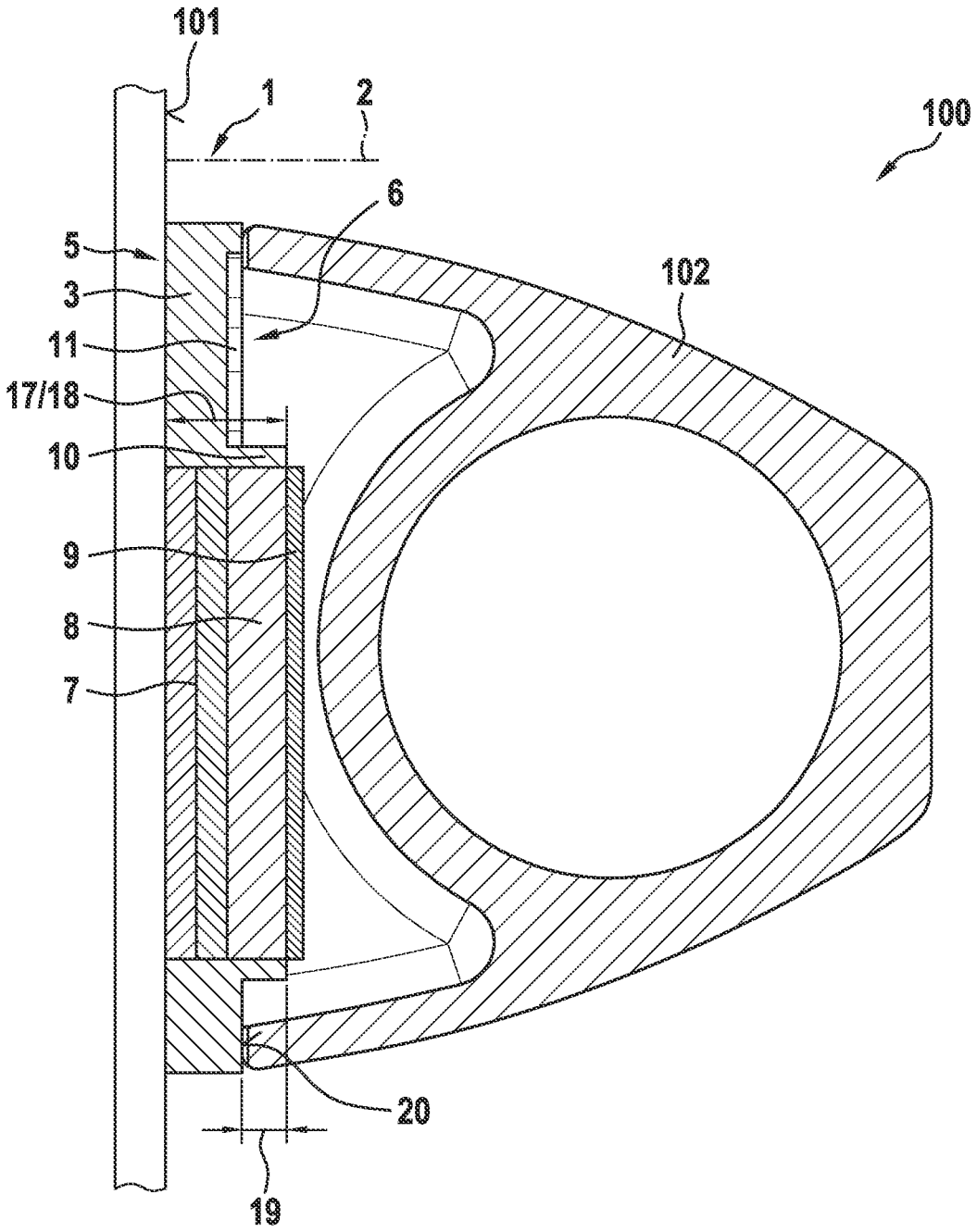

As in particular the section of FIG. 4 shows, the individual reaction chamber 4 is open on both sides. The drive element 7 is directly resting at the mounting surface 101. When thermally activating the drive element 7, the piston plate 8 is pressed in the direction of the door actuator 102. As the drive element 7 and the piston plate 8 are located in the reaction chamber 4, the expanding material of the drive element 7 does not get into the fissured back side of the door actuator 102, but the pressure is directly applied to the door actuator 102 via the piston plate 8.

FIG. 3 shows a length 15 and a width 16 of the individual reaction chamber 4. Length 15 and width 16 are measured perpendicularly to the mounting axis 2 and determine the cross-sectional area of the reaction chamber 4. FIG. 4 reveals a depth 17 of the reaction chamber 4, measured parallel to the mounting axis 2. In this exemplary embodiment, the depth 17 of the reaction chamber 4 also corresponds to the thickness 18 of the frame 2 at the thickest spot.

As FIG. 4 shows, the individual reaction chamber 4 has a border 10 on the entire circumference. Said border 10 extends parallel to the mounting axis 2 with an overhang 19. The overhang 19 is measured starting at a contact surface 20 between door actuator 102 and frame 3. The overhang 19 increases the depth 17 of the reaction chamber 4.

FIGS. 2, 3 and 4 show, that the frame 3 can include at least one pocket 11 on the front side 6. Said pocket 11 forms an air-filled space, which improves the thermal insulation of the frame 3, so that an as small as possible a heat input is realized directly onto the door actuator 102 via the mounting surface 101 and through the frame 3. Such a pocket 11 can be disposed as well on the back side 5 of the frame 3. The pocket 11 can be filled as well, at least partially, with thermally insulating material, in particular firm material.

FIG. 3 shows that the frame 3 includes four first fastening points 12 and four second fastening points 13. The first fastening points 12 are used for screwing the frame to the mounting surface 101. The second fastening points 13 are used for screwing the door actuator 102 to the frame 3. In the second exemplary embodiment, it is not the door actuator 102, which is screwed to the second fastening points 13, but a mounting plate 30.

FIG. 3 reveals for the first and second exemplary embodiments, that one respective first fastening point 12 and one second fastening points 13, each formed as holes, forms a pair. In this case, the distance 14 between two associated fastening points 12, 13 is selected as small as possible.

Figure 5:
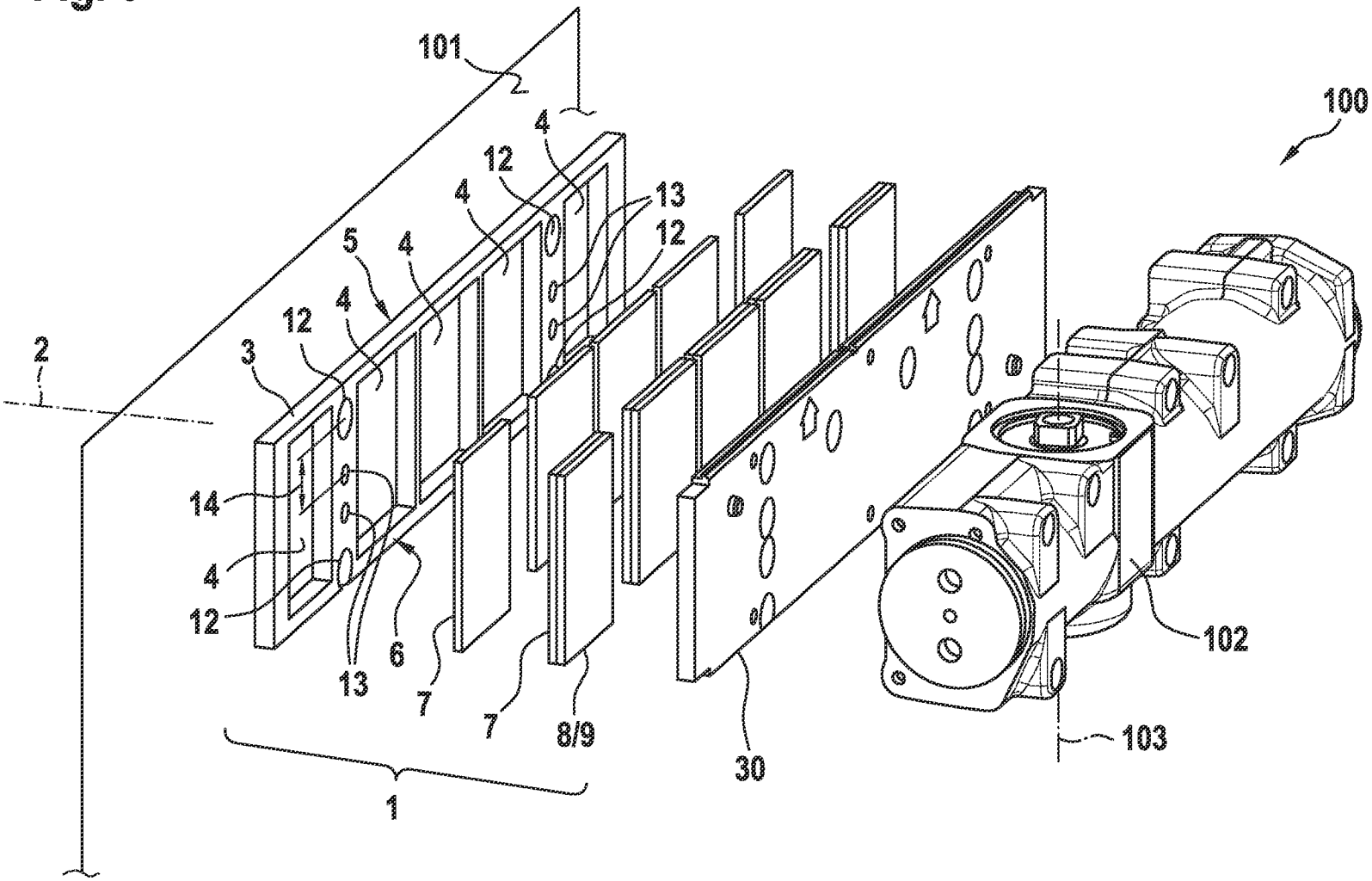

FIG. 5 shows an exploded illustration of the fire protection fastening device 1 at the assembly 100 according to the second exemplary embodiment. Herein, the mounting plate 30 is disposed between door actuator 102 and frame 3. The mounting plate 30 is screwed to the frame 3 via the second fastening points 13.

In the second exemplary embodiment, the frame 3 has five reaction chambers 4. One drive element 7, herein for example also made from two layers, is seated in each reaction chamber 4. A plate is disposed on the front side of the respective drive element 7; said plate can be formed as a piston plate 8 or as an insulating plate 9. Furthermore, at this position, also two sandwiched plates can be used, namely a piston plate 8 and at least one insulating plate 9.

Also in the second exemplary embodiment, the reaction chambers 4 are open on the front side 6 and on the back side 5. On the back side 5, the drive element 7 directly rests at the mounting surface 101.

Figure 6:
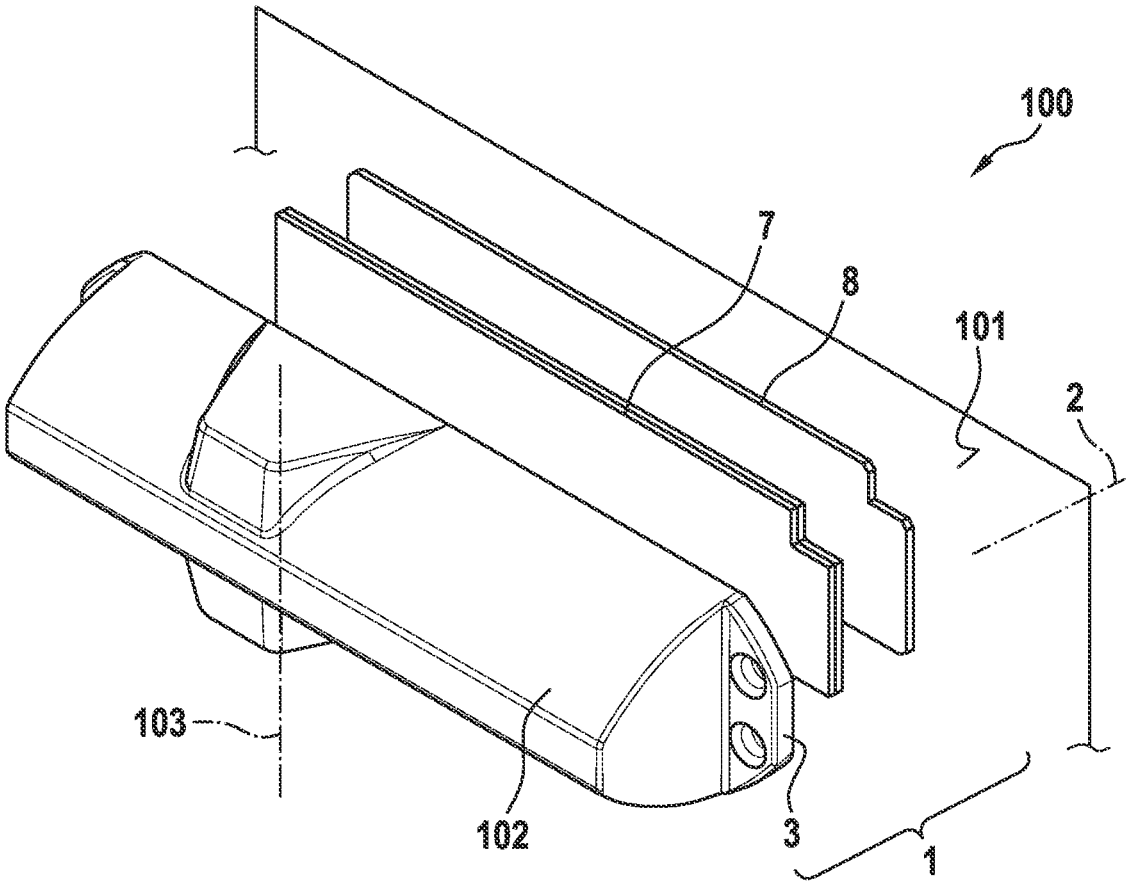
Figure 7:
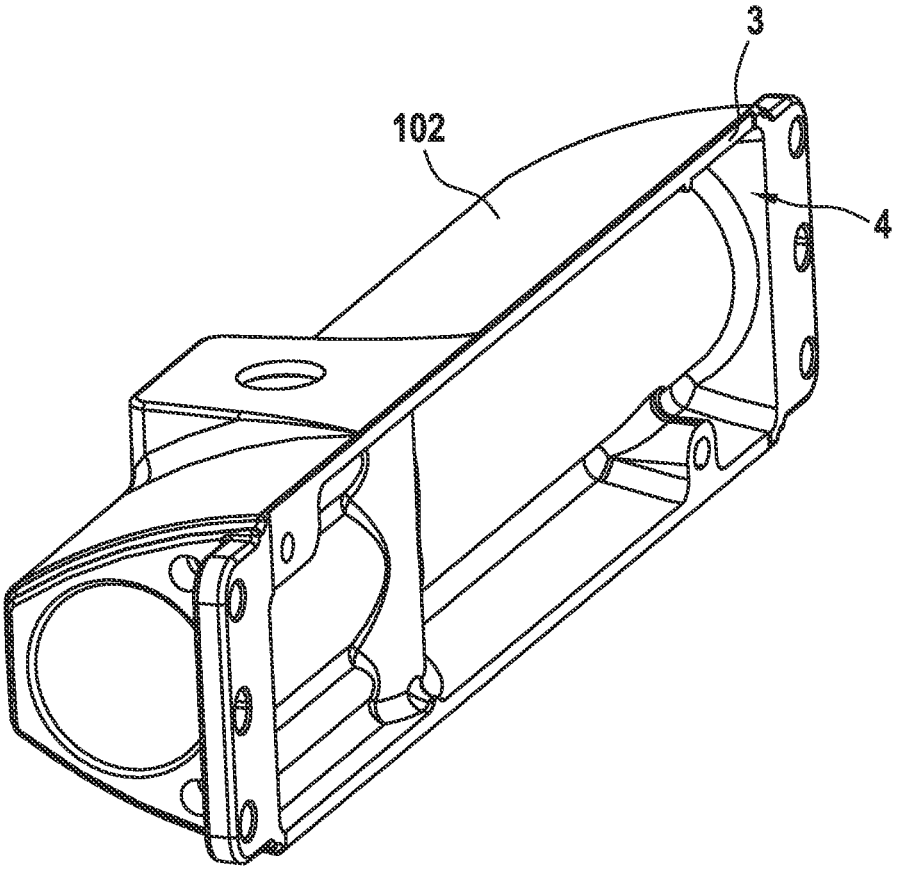

FIGS. 6 and 7 show the configuration of the fire protection fastening device 1 in the assembly 100 according to the third exemplary embodiment. In the third exemplary embodiment, the frame 3 of the fire protection fastening device 1 is an integral component of the door actuator 102. This is in particular seen, when looking at the back side of the door actuator 102 and FIG. 7. Herein, a reaction chamber 4 is formed in the frame 3. According to the exploded illustration in FIG. 6, the drive element 7 and a piston plate 8 are seated in this reaction chamber 4.

The invention claimed is:

1. A fire protection fastening device for fastening a door actuator, the device comprising:

a frame with a back side, configured to be facing a mounting surface, wherein a mounting axis is defined perpendicularly to the back side, and wherein the frame is formed for arrangement between a door actuator and the mounting surface or is an integral component of the door actuator, a reaction chamber formed in the frame, wherein the frame delimits the reaction chamber on the entire circumference, and wherein the reaction chamber is open on at least one of the back side and a front side of the frame opposite the back side, a drive element made from intumescent material disposed in the reaction chamber, which, when thermally activated, is formed for pushing away the door actuator from the mounting surface, and a piston plate disposed in the reaction chamber, which, when thermally activating the drive element, is displaceable by the drive element, in relation to at least one of the frame and the door actuator.

2. The fire protection fastening device according to claim 1, wherein the piston plate is manufactured from non-metallic, thermally insulating material or wherein the piston plate includes at least one layer of non-metallic, thermally insulating material.

3. The fire protection fastening device according to claim 1, wherein, on at least one side of the piston plate, an insulating plate is placed, which is manufactured from non-metallic, thermally insulating material.

4. The fire protection fastening device according to claim 3, wherein at least one of the drive element, and the piston plate, and the insulating plate extends over an entire cross-sectional area of the reaction chamber defined perpendicularly to the mounting axis.

5. The fire protection fastening device according to claim 1, wherein the reaction chamber is open on both the front and back sides over an entire cross-section thereof.

6. The fire protection fastening device according to claim 1, wherein the drive element is exposed on the back side of the frame for direct contact with the mounting surface.

7. The fire protection fastening device according to claim 1, wherein a depth, defined parallel to the mounting surface, of the reaction chamber amounts to between 1 mm and 30 mm, or wherein a cross-sectional area, defined parallel to the mounting surface, of the reaction chamber is between 400 $mm^2$ and 50,000 $mm^2$.

8. The fire protection fastening device according to claim 1, wherein the reaction chamber comprises a plurality of reaction chambers, and wherein a sum of cross-sectional areas, defined perpendicularly to the mounting axis, of the plurality of reaction chambers is at least 2,500 $mm^2$.

9. The fire protection fastening device according to claim 1, wherein the frame includes first fastening points formed as holes configured for screwing to the mounting surface, and wherein the frame includes second fastening points formed as holes configured for screwing the door actuator or a mounting plate to the frame.

10. The fire protection fastening device according to claim 9, wherein two respective first and second fastening points next to each other form a pair and the distance between first fastening point and second fastening point of a pair is at most 5 times a thickness of the frame.

11. An assembly, comprising a door actuator and a fire protection fastening device according to claim 1, wherein the frame is an integral component of the door actuator.

12. An assembly, comprising a door actuator and a fire protection fastening device according to claim 1, wherein the door actuator is configured to be fastened directly to the frame.

13. An assembly, comprising a door actuator, a mounting plate and a fire protection fastening device according to claim 1, wherein the mounting plate is configured to be fastened directly to the frame, and wherein the door actuator is configured to be fastened directly to the mounting plate.

* * * * *